United States Patent [19]

Fuller et al.

[11] Patent Number: 5,000,314

[45] Date of Patent: Mar. 19, 1991

[54] UNIT DOSE PACKAGE

[75] Inventors: Ronald C. Fuller; Michael C. Tao, both of Evansville, Ind.

[73] Assignee: Bristol-Myers Company, New York, N.Y.

[21] Appl. No.: 299,489

[22] Filed: Jan. 23, 1989

[51] Int. Cl.[5] ..... B65D 25/08

[52] U.S. Cl. ..... 206/221; 206/219; 215/DIG. 8

[58] Field of Search ..... 206/219, 221, 268, 222; 215/6, DIG. 8; 220/417, 450, 456

[56] References Cited

U.S. PATENT DOCUMENTS

| | | | |
|---|---|---|---|
| Re. 29,916 | 2/1979 | Schmid et al. . | |
| 1,064,442 | 6/1913 | Cadigan | 215/6 |
| 1,731,847 | 10/1929 | Echart, Jr. | 206/221 |
| 1,960,858 | 5/1934 | Strauch | 206/221 |
| 2,784,949 | 3/1957 | Dennon . | |
| 2,876,113 | 3/1959 | Barton . | |
| 3,039,601 | 6/1962 | Martin | 206/507 |
| 3,156,369 | 11/1964 | Bowes et al. . | |
| 3,281,008 | 10/1966 | D'Andrea | 220/450 |
| 3,489,306 | 1/1970 | Bubb | 206/221 |
| 3,720,522 | 3/1973 | Nakagami . | |
| 3,720,524 | 3/1973 | Nakagami . | |
| 3,796,337 | 3/1974 | Seunevel . | |
| 3,796,813 | 3/1974 | Kurland . | |
| 3,802,604 | 4/1974 | Morane | 206/222 |
| 3,888,224 | 6/1975 | Okuhara et al. | 220/450 |
| 3,891,125 | 6/1975 | Morane . | |
| 3,924,741 | 12/1975 | Kachur et al. . | |
| 4,157,147 | 6/1979 | DeForest et al. | 220/457 |
| 4,196,841 | 4/1980 | Smith et al. | 220/450 |
| 4,264,007 | 4/1981 | Hunt . | |
| 4,614,437 | 9/1986 | Buehler . | |
| 4,693,366 | 9/1987 | Goncalues | 206/222 |
| 4,702,390 | 10/1987 | Rinkovsky, Sr. | 220/450 |
| 4,757,916 | 7/1988 | Goncalues | 206/222 |
| 4,762,224 | 8/1988 | Hall | 206/221 |
| 4,846,342 | 7/1989 | Amos | 206/222 |

FOREIGN PATENT DOCUMENTS

| | | | |
|---|---|---|---|
| 138016 | 6/1934 | Australia | 206/221 |

*Primary Examiner*—David T. Fidei

[57] ABSTRACT

A unit dose package, which is usable with a bottle to reconstruct the contents of the package, has a plastic fitment which defines a mouth opening for the package. The plastic fitment is bonded to a wall of the package and has a channel which receives the neck of the bottle. A flexible foil membrane seal is removably attached to this plastic fitment and is covered by a protective overcap.

4 Claims, 2 Drawing Sheets

UNIT DOSE PACKAGE

FIELD OF THE INVENTION

The present invention is directed generally to a unit dose package. More particularly, the present invention is directed to a unit dose package for a reconstitutable powder. Most specifically, the present invention is directed to a unit dose package for a reconstitutable nutritional infant or adult formula powder form. A unit dose container carries a pre-measured amount of the nutritional formula The container has a plastic fitment which is provided with a mouth opening and with an annular threaded recess. The threaded recess is sized to cooperate with a threaded neck of a graduated bottle that contains a measured amount of a reconstituting liquid. In use, an overcap and a foil seal are removed from the unit dose package's fitment. Once this has been done, the dose package and graduated bottle are secured together and the contents of the unit dose package reconstituted by being mixed with the liquid in the graduated bottle. When secured together, the dose package and graduated bottle allow ample capacity to complete mixing of the powder and liquid because of the extra head space provided by the dose package.

DESCRIPTION OF THE PRIOR ART

Various infant and adult nutritional formulas are generally well known in the art. These typically take the form of powders or concentrated liquids which must be reconstituted or suitably diluted prior to usage. Particularly when using powdered nutritional formulas, a measured amount of the powder must be combined and then mixed with a corresponding volume of a reconstituting liquid prior to use.

Powdered nutritional formulas are frequently packaged in a bulk container which may be supplied to the user with a measuring scoop or spoon of some type. The user is then required to remove the appropriate dry measure of the powdered formula from the bulk container and to add this powdered formula to a volume of reconstituting liquid, typically water, in a baby bottle or mixing container. This procedure is apt to be less than ideal for several reasons. In the process of removing powdered formula from a bulk container with a scoop and transferring this powder to the liquid container, there is a significant opportunity to spill some of the formula. Such spillage obviously creates a mess which must be cleaned up. More importantly, such spillage is apt to adversely affect the accuracy of the reconstituted formula.

An associated problem with manual mixing of a powdered or concentrated nutritional formula with a reconstituting liquid is one of incorrect formula strength caused by inaccurate formula measurement. When a group of people were asked to prepare a formula using a certain number of scoops of powdered formula, a wide range of product concentrations was observed. People often have a difficult time properly measuring the proper amount of the powdered nutritional formula and properly mixing it with the reconstituting liquid.

Another problem is obtaining thorough mixing of powdered formula because of the lack of head space when the nursing bottle containing the reconstituting liquid is full. The unit dose package of the instant invention provides extra head space when secured to the nursing bottle thereby permitting complete mixing.

When using a bulk container of a powdered infant or adult nutritional formula, there is clearly the possibility that the bulk container, once it has been opened, may become contaminated. In a home environment, such possible contamination will typically be accidental, while in a hospital or similar setting it may not be. The hospital is apt to be quite reluctant to expose itself to the potential liability which usage of a bulk powdered nutritional formula may mean. Thus, a more costly alternative may be selected in order to avoid any potential risk of contamination.

Measuring a mixing of a reconstitutable powdered nutritional formula is apt to be more time consuming than some parents are willing to spend. Similarly, hospital nurseries and other institutional users of powdered nutritional formulas cannot afford to spend a great deal of time measuring and mixing the particular formulas required by the various babies or persons being cared for. Thus, the conventional arrangement of a bulk powdered reconstitutable nutritional formula is unacceptable to these users.

The use of powdered infant and adult nutritional formulas which must be reconstituted by mixing a measured portion of the formula with liquid has, as discussed above, various disadvantages. The mixing process is apt to be messy and may take more time than many parents and virtually all hospital nurseries are willing to take. It is also often difficult to obtain an accurate measure of the powder. Bulk containers of formula are also possible targets of product contamination or adulteration. Thus, it will be clear that a need exists for a unit dose package which will overcome these drawbacks of the prior art devices. The unit dose package, in accordance with the present invention, provides such a package and represents a significant advance in the art.

SUMMARY OF THE INVENTION

It is an object of the present invention to provide a unit dose package.

Another object of the present invention is to provide a unit dose package for mixing and dispensing liquid and powdered nutritional formulas.

A further object of the invention is to provide a unit dose package which is usable with a bottle to form a mixing container.

Yet another object of the present invention is to provide a unit dose package which is hermetically sealed and tamper resistant.

Still a further object of the present invention is to provide a unit dose package that facilitates formula reconstitution without mess or error.

Even yet another object of the present invention is to provide a unit dose package that provides the user with an accurate amount of formula for reconstitution.

Still even a further object of the present invention is to provide a unit dose package which is quick and easy to use.

Still another object of the present invention is to provide a unit dose package that provides additional head space for complete mixing of powder and reconstituting liquid.

As will be discussed in greater detail in the description of the preferred embodiment which is set forth subsequently, the unit dose package in accordance with the present invention includes a unit dose container which has a closed bottom and a plastic fitment having a mouth which is bounded by a threaded recess. The threaded recess is sized to be cooperative (compatible) with the neck of a plastic bottle. This plastic fitment is sealed by a foil closure seal and which, in turn is covered by an overlying protective overcap.

The unit dose package is supplied to the user with a measured amount of a nutritional formula, typically a powder. An appropriate amount of reconstituting liquid, such as water, is placed in a graduated plastic nurser bottle and the overcap and foil membrane seal are removed from the plastic fitment of the unit dose package. The neck of the bottle is screwed into the recess in the plastic fitment, as the unit dose package is inverted. The contents of the unit dose package are thus added to the reconstituting liquid. The combined unit dose package and plastic bottle provide a closed system with sufficient space to insure that the nutritional formula can be easily and thoroughly mixed with the reconstituting liquid by shaking the closed system.

In marked contrast to the prior art approaches which required removal of an amount of powder from a bulk container and addition of this powder to the liquid, the unit dose package of the present invention eliminates the spillage, mess, and possible inaccuracies which accompanied the prior art. Each unit dose container is supplied to the user with an appropriate quantity of nutritional formula which has been pre-measured during packaging. The formula is added to the reconstituting liquid once the unit does package and plastic nursing bottle have been cooperatively joined together. Thus, all of the formula is mixed with the liquid and the correct amount of formula is utilized.

Each unit dose package is intended to be used only once. Further, various formula strengths and compositions can be provided in appropriately labeled containers. Since each package is a unit dose, no time is wasted in measuring and mixing. The proper unit dose package is selected, opened, combined with a bottle, and mixed for use. This convenience and time saving aspect of the present invention makes it particularly attractive for busy parents and even more attractive to hospital nurseries and similar facilities.

The unit dose package is a hermetically sealed package which may be filled and sealed under a nitrogen or similar inert atmosphere to provide a product with a long shelf life. The plastic overcap protects the metal foil membrane seal which itself provides excellent tamper evidence. When this foil seal is removed, it will take with it a portion of the container itself. Thus, if the container is washed for reuse, it will be apt to start to decompose. Thus, it is a disposable package which has been structured to prevent reuse.

The unit dose package in accordance with the present invention provides a package through which a reconstitutable nutritional formula can be accurately, efficiently, and effectively mixed with a reconstituting liquid for use. It eliminates formula spillage and inaccurate measurements. At the same time, it reduces the time required to prepare and mix the formula while also minimizing the possibility of product contamination. Also, it allows sufficient head space to thoroughly mix the nutritional powder and reconstituting liquid. The unit dose package of the present invention is clearly superior to prior art devices and performs its desired functions in an expeditious manner.

BRIEF DESCRIPTION OF THE DRAWINGS

While the novel features of the unit dose package in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENTS

Figure 1:
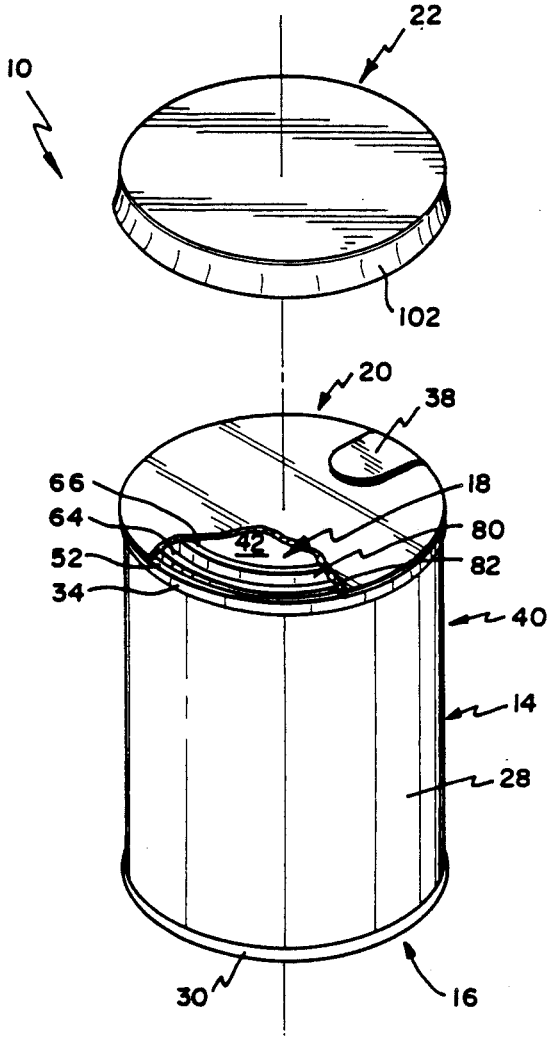
FIG. 1 is an exploded perspective view of the unit dose package of the present invention.
Figure 2:
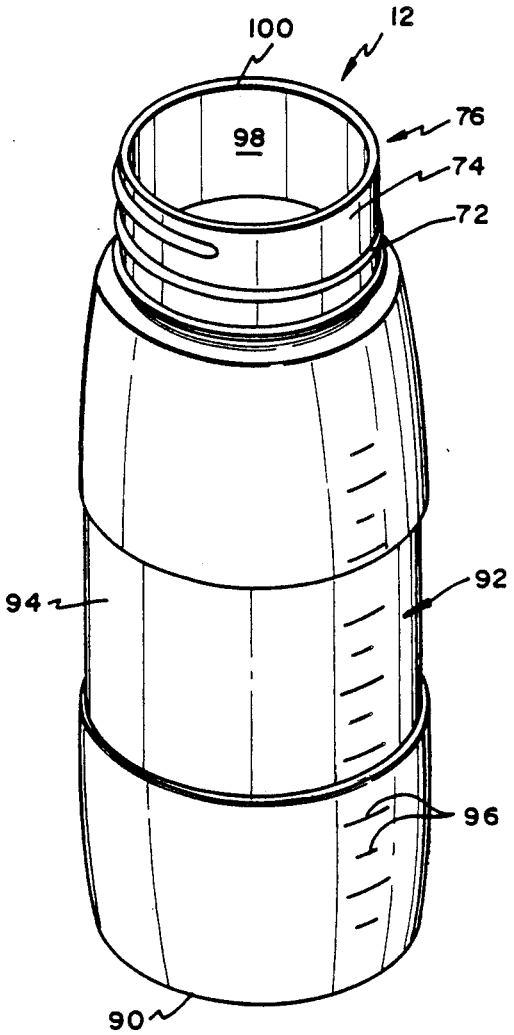
FIG. 2 is a perspective view of a graduated nursing bottle usable with the unit dose package of FIG. 1.
Figure 4:
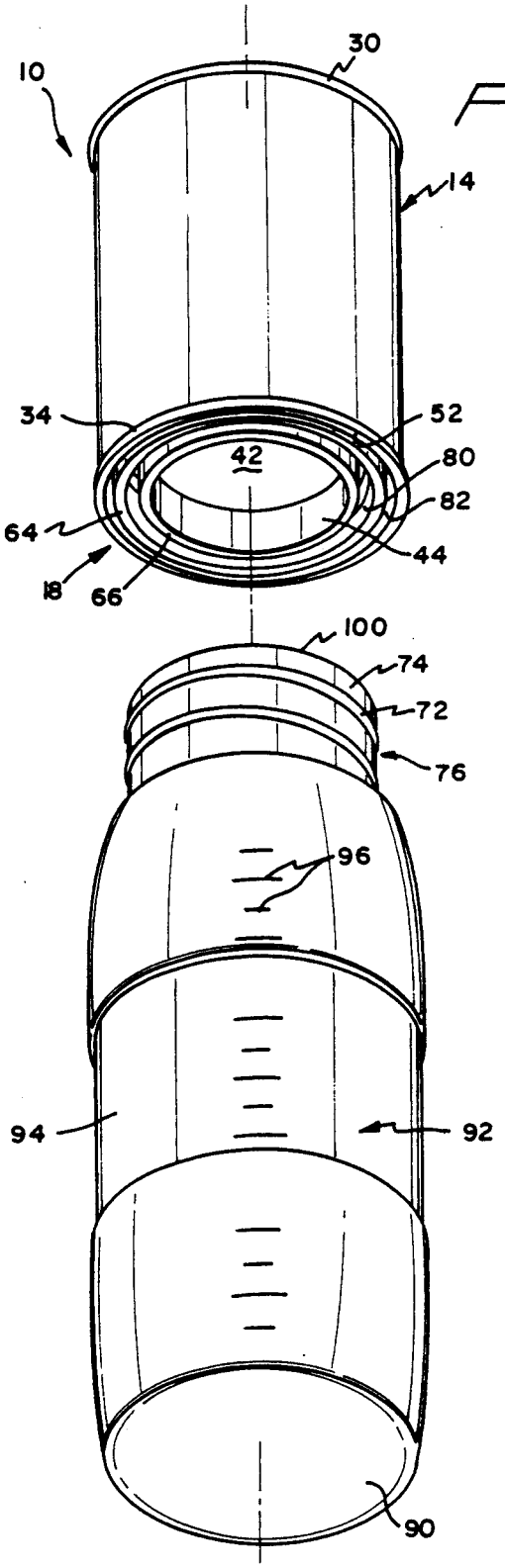
FIG. 4 is an exploded perspective view of the unit dose package and bottle complimentarily positioned.
Figure 3:
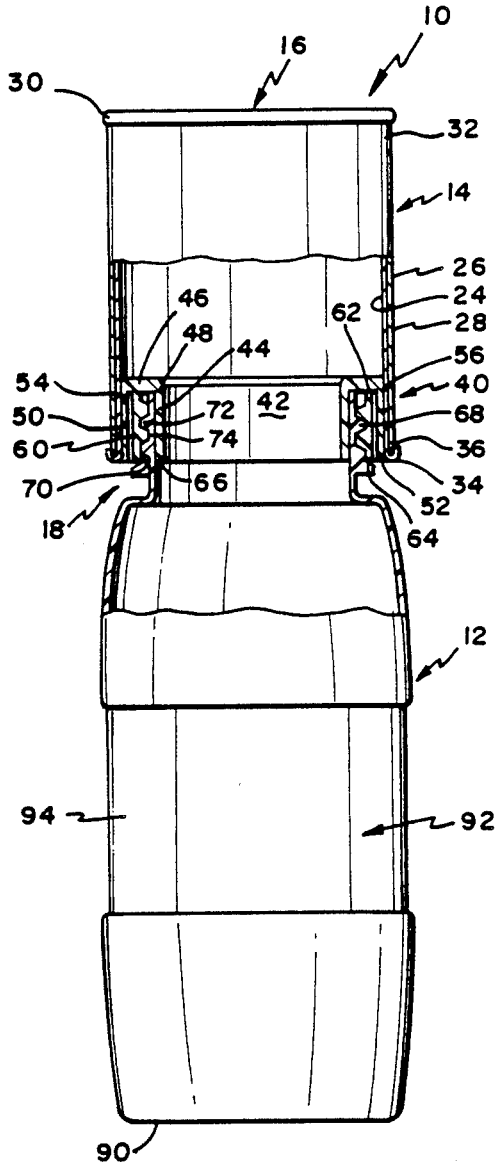
FIG. 3 is an elevation view, partly in section and showing the unit dose package and bottle in their assembled, mixing position.

Referring initially to FIG. 1 there may be seen, generally at 10, a unit dose package in accordance with the present invention. As will be discussed in greater detail shortly, unit dose package 10 is usable with a cooperating bottle, typically a plastic graduated nursing bottle, generally at 12 in FIG. 2. Unit dose package 10 and bottle 12 are securable together in a manner as is shown in FIG. 3 to provide a closed system for mixing and reconstitution of the contents of the unit dose package with a reconstituting liquid which is in bottle 12. After such mixing and reconstitution, the now empty unit dose package 10 may be separated from bottle 12, as shown in FIG. 4 and the contents of bottle 12 may now be used in a generally conventional and well known manner. While unit dose package 10 will be discussed hereinafter as containing a powdered nutritional formulation, such as powdered baby formula, and further while bottle 12 will be discussed as being a plastic graduated nursing bottle in which the reconstituting liquid is water, it will be understood that this is for ease of explanation and that the contents of unit dose package 10 are not to be construed as being so limited and that the bottle and its reconstituting liquid also are not so limited.

Returning again to FIG. 1, unit dose package 10 includes a generally cylindrical body 14, a metal container bottom 16 secured to the bottom of the cylindrical body 14, a plastic fitment 18 secured to an upper portion of cylindrical body 14, a foil seal membrane 20 which is removably sealed to plastic fitment 18, and a protective overcap 22 that overlies and protects metal foil membrane 20. This unit dose package 10 is ideally structured for fillage on a high speed packaging line with a dry infant or adult nutritional formula and when filled and closed, forms a hermetically sealed package in which the powdered formula may be sealed under a nitrogen atmosphere to give the product a long shelf life.

Cylindrical body 14 of unit dose package 10, as may be seen in FIGS. 1 and 4, is a composite which preferably includes an inner liner 24 of a foil and polypropylene coated kraft paper, and one or more outer body plies 26 which may be of a suitable kraft paper. Outer surface 28 of cylindrical body 14 may be a suitable print receiving paper or aluminum foil which may be treated, after printing, with a generally well known lacquer. Metal package bottom 16 is provided with an outer peripheral flange 30 which may define an appropriately dimensioned channel (not shown) into which a bottom edge 32 of cylindrical body 14 may be sealingly secured. As will be understood by those in the art, this bottom 16 is typically attached to cylindrical body 14 after the contents have been placed inside unit dose package 10. The bottom end 16 is scamed onto bottom edge 32 of cylindrical body 14 with automatic can end scaming equipment.

As may be seen most clearly in FIG. 3, the upper portion of inner liner 26 of cylindrical body 14 terminates in a radially outwardly and downwardly extending curl 34. This curl rolls over an upper edge 36 of the outer body plies 26. Curl 34 provides a surface to which the foil seal membrane 20 may be bonded. Membrane 20, as may be seen most clearly in FIG. 1, overlies plastic fitment 18 and curl 34. The foil membrane 20 is preferably formed of a foil with a hot melt adhesive that can be bonded by suitable R.F. sealing means or other heat means to the top of fitment 18 and to the foil and polypropylene on curl 34. When foil membrane seal 20 is removed, such as by grasping the integral pull tab 38, a portion of the foil and polypropylene on curl 34 will also be removed. This will expose a portion of the paper portion of liner 24. Thus, if an attempt is made to wash unit dose package 10 after it has been opened, it will start to decompose. This will discourage reuse of package 10.

Turning now to FIGS. 3 and 4, plastic fitment 18 will be seen as being situated within cylindrical body 14 of unit dose package 10 generally adjacent an upper portion 40 of body 14 when the unit dose package 10 is in the upright position depicted in FIG. 1. Plastic fitment 18 includes a central open mouth 42 which is defined by an annular mouth ring 44. A transverse web 46 extends radially outwardly from a bottom portion 48 of mouth ring 44. An attachment ring 50, which is generally concentric with mouth ring 44, is formed integrally with, and extends generally perpendicular to transverse web 46 of plastic fitment 18. Attachment ring 50 has an upper rim 52 which is situated adjacent curl 34 when plastic fitment 18 is slid into the upper portion 40 of cylindrical body 14 of unit dose package 10. An outer peripheral surface 54 of attachment ring 50 is coextensive with an upper inner surface 56 of inner linear 24 of cylindrical body 14. Surface 54 of attachment ring 50 of plastic fitment 18 and inner surface 56 of inner liner 24 are bonded together by suitable R.F. heating or other similar heating. This bonding is strong enough to resist any rotational torque which might be applied to plastic fitment 18 when it is secured to, or removed from bottle 12, as will be discussed subsequently. The bonding also provides a water tight seal that does not leak when the powder and liquid are mixed together.

A threaded ring 60 is also formed as a segment of plastic fitment 18. As may best be seen in FIG. 3, threaded ring 60 is concentric with, and spaced between inner mouth ring 17 and outer attachment ring 50. Threaded ring 60 is joined at a lower portion 62 to transverse web 46 and terminates in an upper rim 64 which is generally co-planar with upper rim 52 of attachment ring 50 and an upper rim 66 of mouth ring 44. A helical screw thread 68 is molded on the radially inner surface 70 of threaded ring 60. This thread 68 is sized to cooperate with the generally conventional helical screw thread 72 that is found on the outer neck surface 74 of a neck portion 76 of bottle 12. An inner, bottle neck receiving channel 80 is defined by mouth ring 44, threaded ring 60 and their connecting portion of transverse web 46. A spacing channel 82 is defined between threaded ring 60, outer attachment ring 50 and their connection portion of transverse web 46.

An optional feature of the invention not shown by the drawings comprises a water soluble membrane covering open mouth 42 of plastic fitment 18 or spaced within the annular mouth ring 44 to contain the contents of the unit dose package. Preferably, the water soluble membrane is formed of rice paper but other water soluble membranes of carbohydrate based material such as corn starch, potato starch, wheat starch, tapioca starch, etc. can be used. The membrane is attached to lower ring 65 or secured within the annular mouth ring 44 by suitable R.F. sealing means. The membrane insures that no spillage of the nutritional powder formula will occur when unit dose package 10 is turned into the inverted position shown in FIG. 3. Upon shaking the assembly, the water soluble membrane dissolves and mixing of the contents of unit dose package 10 and bottle 12 can be accomplished.

As previously alluded to, bottle 12 is preferably a graduated nursing bottle that is molded from a suitable plastic in a generally conventional configuration. Bottle 12 has a bottom 90, a generally cylindrical sidewall 92 which may have a reduced diameter central region 94 to facilitate grasping, and a plurality of graduation marks 96 which may include an upper maximum fill line. Bottle 12 has an open mouth 98 which is defined by bottle neck 76. This neck 76 terminates in an upper neck rim 100, all in a generally conventional manner. As may be seen in FIG. 3, the surface of bottle neck rim 100 will abut the upper surface of transverse web 46 of plastic fitment 46 when unit dose package 10 is crewed onto the neck 76 of bottle 12.

Empty unit dose packages 10 which have been provided by the fabricator with metal bottoms 16 not attached, are given a highly accurate filling of a powdered reconstitutable infant or adult nutritional formula on a high speed packaging line. Once the formula has been placed in the package, the metal bottom is attached by normal can end scaming equipoment. The unit dose package 10 can now be shipped and stored until usage. When the user is ready to reconstitute and mix the formula, he first adds the appropriate volume of reconstituting liquid to bottle 12 using graduations 96 as a guide. He then may remove protective overcap 22 by grasping a rim portion 102 thereof. This overcap 22 is preferably fabricated of a thin polystyrene material and snap fits over the upper end of a unit dose package 10. Once overcap 22 has been removed, the user can visually inspect foil membrane 20 to insure that it has not been tampered with. Having done this, the user may then remove foil membrane 20 by grasping the pull tab 38 and pulling upwardly on it. This force will separate the foil membrane seal 20 from the upper rims 52, 64 and 66 of the plastic fitment, and from the curl 34 of the inner liner 24. Grasping bottle 12 in one hand and now open unit dose package 10 in the other, the user will insert the neck 76 of bottle 12 into the neck receiving channel 80 of plastic fitment 18 while turning unit dose package 10 into the inverted position shown in FIG. 3. Any slight discrepancy between the diameter of bottle neck 76 and the inner circumference of threaded ring 60 can be accommodated by flexure of ring 60 into spacing channel 82. Unit dose package 10 is typically not completely filled with formula so this inversion of package 10 is accomplished without spillage of the package's contents. With the unit dose package 10 securely affixed atop bottle 12 through the cooperation of the screw threads 68 on threaded ring 60 of plastic fitment 18, and the screw threads 72 on bottle neck 76, thorough mixing of the contents of the unit dose package 10 and the bottle 12 can be accomplished by shaking the assembly. The added headspace created through the attachment of unit dose package 10 to the bottle 12 provides adequate room for efficient formula reconstitution by shaking. Once such reconstitution has been accomplished, the now empty unit dose package 10 may be removed from the neck 76 of bottle 12 and discarded, as shown in FIG. 4. A suitable closure device, such as a well known resilient nipple and seal ring assembly (not shown) may now be applied to bottle neck 76 and the bottle 12 can now be used for its intended function.

The unit dose package 10 in accordance with the present invention has many beneficial attributes. Since each unit dose package was accurately filled, uniformity of the reconstituted product is assured. There is no mess, spillage or wastage associated with the unit dose packages, and essentially sterile condition may be maintained as the unit dose package is kept closed and sealed until immediately prior to usage. The unit dose package 10 of the present invention is intended primarily for use with an 8 oz. plastic nurser bottle 12. However, unit dose packages and bottles in other sizes could also be provided. Also, as was discussed above, the unit dose package of the present invention is equally suited for use with liquid products to be mixed with other liquids. It will thus be apparent that the unit dose package in accordance with the present invention provides an accurate, reproducible device for reconstituting or mixing two constituents in a manner which eliminates mess and saves time in measuring and mixing.

While a preferred embodiment of a unit dose package in accordance with the present invention has been set forth fully and completely hereinabove, it will be apparent to one of skill in the art that a number of changes in, for example, the type of plastics used for the plastic fitment and bottle, the types of heat activated adhesives used, the overall size of the package, and the contents of the package and the reconstituting liquid may be made without departing from the true spirit and scope of the subject invention which is accordingly to be limited only by the following claims.

What is claimed is:

1. A unit dose package comprising:

a body having a wall, a bottom, and a mouth opening;

a plastic fitment sealed in said mouth opening, said plastic fitment including a fitment mouth providing access to an interior portion of said body and a spacing channel and a container neck receiving channel, said container neck receiving channel encircling said fitment mouth and adapted to receive a neck of an attachable container, said spacing channel encircling said container neck receiving channel; and a sealing membrane removably secured to said plastic fitment and in sealing contact with the exterior portion of said fitment mouth above said spacing channel and said container neck receiving channel.

2. The unit dose package of claim 1 wherein said container neck receiving channel and said spacing channel are separated by a threaded ring.

3. The unit dose package of claim 2 wherein said threaded ring has a helical screw thread on a radially inner surface.

4. The unit dose package of claim 1 wherein said plastic fitment includes a water soluble membrane, said soluble membrane covering said fitment mouth defined by an annular mouth ring or spaced within said annular mouth ring.

* * * * *